US009984803B2

(12) United States Patent
Takemoto et al.

(10) Patent No.: US 9,984,803 B2
(45) Date of Patent: May 29, 2018

(54) COIL BOBBIN AND ELECTROMAGNETIC DEVICE

(71) Applicant: Mitsubishi Electric Corporation, Tokyo (JP)

(72) Inventors: Tomohiko Takemoto, Tokyo (JP); Yasuhisa Hyakuta, Tokyo (JP); Yuma Yamamatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days. days.

(21) Appl. No.: 15/512,949

(22) PCT Filed: Sep. 30, 2014

(86) PCT No.: PCT/JP2014/005010
§ 371 (c)(1),
(2) Date: Mar. 21, 2017

(87) PCT Pub. No.: WO2016/051433
PCT Pub. Date: Apr. 7, 2016

(65) Prior Publication Data
US 2017/0301447 A1 Oct. 19, 2017

(51) Int. Cl.
*H01F 5/02* (2006.01)
*H01F 7/16* (2006.01)

(52) U.S. Cl.
CPC ..... *H01F 7/1615* (2013.01); *H01F 5/02* (2013.01); *H01F 7/1623* (2013.01)

(58) Field of Classification Search
CPC ..... H01F 5/02; H01F 7/1615; H01F 7/1623
See application file for complete search history.

(56) References Cited

U.S. PATENT DOCUMENTS

| | | | |
|---|---|---|---|
| 6,932,320 | B2 | 8/2005 | Fukano et al. |
| 2003/0102453 | A1 | 6/2003 | Fukano et al. |

FOREIGN PATENT DOCUMENTS

| | | | |
|---|---|---|---|
| CN | 1424522 | A | 6/2003 |
| JP | 57163023 | U | 10/1982 |
| JP | 59-73622 | A | 4/1984 |
| JP | 61-39907 | U | 3/1986 |
| JP | 02-14169 | Y2 | 4/1990 |
| JP | 03-083304 | A | 4/1991 |
| JP | 11-074117 | A | 3/1999 |

(Continued)

OTHER PUBLICATIONS

Communication dated Nov. 14, 2017, from State Intellectual Property Office of the P.R.C. in counterpart application No. 201480082314.9.

(Continued)

*Primary Examiner* — Ramon M Barrera
(74) *Attorney, Agent, or Firm* — Sughrue Mion, PLLC; Richard C. Turner

(57) ABSTRACT

The electromagnetic device includes a coil bobbin around which a coil is wound and that is formed from a non-magnetic material, and a movable core that is provided in a cylindrical hollow portion of the coil bobbin and moves by excitation of the coil. A first protrusion and a second protrusion facing a part of the lower half of the movable core are formed on the inner peripheral surface of the cylindrical hollow portion in ranges extending from two openings to a middle point of the coil bobbin, respectively, and the movable core is supported by the first protrusion and the second protrusion when the movable core moves.

6 Claims, 6 Drawing Sheets

(56) References Cited

FOREIGN PATENT DOCUMENTS

| | | | |
|---|---|---|---|
| JP | 2003-172469 | A | 6/2003 |
| JP | 2007-207777 | A | 8/2007 |
| JP | 2010-212016 | A | 9/2010 |
| TW | 128125 | | 2/1990 |
| TW | 200300832 | A | 6/2003 |

OTHER PUBLICATIONS

Taiwanese Notification of Reason for Refusal issued in TW 104131398 dated Dec. 13, 2016.
Japanese Notification of Reason for Refusal issued in JP 2016-551119 dated Jan. 4, 2017.
International Search Report of PCT/JP2014/005010 dated Dec. 9, 2014.
Communication dated Jun. 13, 2017, issued by the Japanese Patent Office in counterpart application No. 2016-551119.

COIL BOBBIN AND ELECTROMAGNETIC DEVICE

CROSS REFERENCE TO RELATED APPLICATIONS

This application is a National Stage of International Application No. PCT/JP2014/005010 filed Sep. 30, 2014, the contents of which are incorporated herein by reference in its entirety.

FIELD

The present invention relates to a coil bobbin and an electromagnetic device.

BACKGROUND

Conventional electromagnetic devices have a movable core passing through the interior of a coil bobbin around which a coil is wound. Because the coil bobbin and the movable core are movable, the movement of the movable core causes the coil bobbin to be worn away. Movable wear debris that is generated from the coil bobbin increases as the coil bobbin is worn away, thereby increasing friction of the movable core when it moves. This causes the movement of the movable core to be unstable, which results in a reduced life of the electromagnetic device. Consequently, a coating made from a rigid polyvinyl chloride resin is applied to the movable core or the movable core is provided with an irregular surface to make recessed portions serve as oil reservoirs, thereby improving movability and ensuring the life of the device. The electromagnetic device as described above, in which the coil bobbin and the movable core are movable, is disclosed as a conventional technology.

CITATION LIST

Patent Literature

Patent Literature 1: Japanese Patent Application Laid-Open No. H3-83304

Patent Literature 2: Japanese Patent Application Laid-Open No. 2010-212016

SUMMARY

Technical Problem

With the conventional technology, however, when the coating that is made from a rigid polyvinyl chloride resin and is applied to the movable core is exfoliated by opening and closing of an electromagnetic contactor or the like, the exfoliated part of the movable core scrapes off the coil bobbin to generate movable wear debris. Moreover, with the conventional technology where the movable core is provided with an irregular surface to make the recessed portions serve as oil reservoirs, there is a concern that deterioration of the oil over time causes the movable core and the coil bobbin to stick to each other.

As has been described, the conventional technology has a problem in that movable wear debris increases due to the exfoliation of the coating made from a rigid polyvinyl chloride resin or a problem in that the movable core and the coil bobbin stick to each other.

The present invention has been made in order to solve such problems and an object of the present invention is to reduce wear of the coil bobbin and the movable core caused by the movement thereof and to reduce movable wear debris.

Solution to Problem

A coil bobbin according to an aspect of the present invention is a coil bobbin to be used with a coil wound around a body, provided with a cylindrical hollow portion in a center of the body, and used in an electromagnetic device that moves a movable core due to magnetic force generated by energization of the coil, with the movable core being inserted from one of two openings of the cylindrical hollow portion, the two openings being maintained at substantially a same height. A first protrusion and a second protrusion facing a part of a lower half of the movable core are formed on an inner peripheral surface of the cylindrical hollow portion in ranges extending from the two openings to a middle point, respectively, and the movable core is supported by the first protrusion and the second protrusion when the movable core moves.

Advantageous Effects of Invention

The present invention includes a protrusion according to the present invention; therefore, wear of the coil bobbin and the movable core due to the movement thereof can be reduced and movability of the movable core can be further improved compared to conventional electromagnetic devices.

DESCRIPTION OF EMBODIMENTS

First Embodiment

An embodiment of the present invention will now be described with reference to FIGS. 1, 2, and 3. Note that the present invention is not to be limited to the embodiment.

Figure 1:
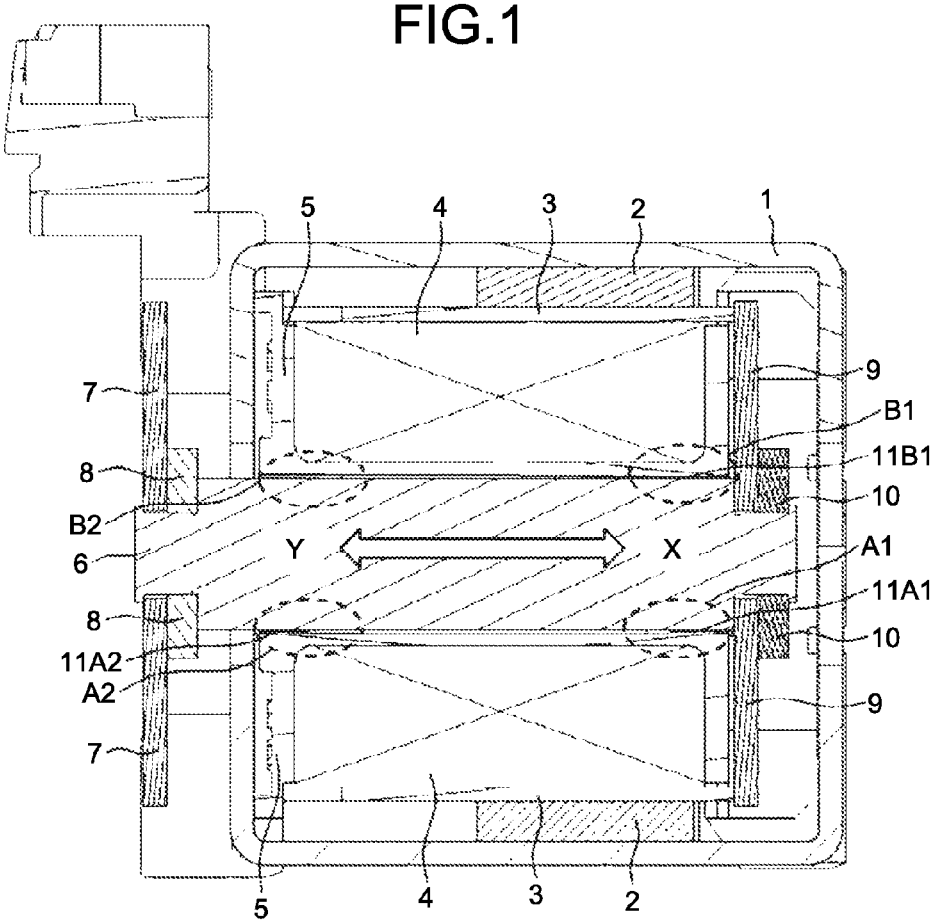
FIG. 1 is a sectional view in a lateral direction of an electromagnetic device according to a first embodiment of the present invention.

FIG. 1 is a sectional view in a lateral direction of an electromagnetic device according to a first embodiment of the present invention. Each component of the electromagnetic device will be described with reference to FIG. 1.

A fixed core 1 is U-shaped. A permanent magnet 2 has one magnetic pole face (such as an S pole face) in contact with each of the upper inner side face and the lower inner side face of the fixed core 1 with the opening of the fixed core 1 as a center. An auxiliary core 3 is in contact with the other magnetic face (such as an N pole face) of the permanent magnet 2, which is in contact with each of the upper inner side face and the lower inner side face of the fixed core 1. A coil 4 is also provided. The coil 4 is wound around the surface of a coil bobbin 5. Note that as illustrated in FIG. 1, the coil bobbin 5 is disposed such that it is in contact with the other side of the auxiliary core 3. Moreover, the coil bobbin 5 is made from a non-magnetic material and provided with a cylindrical hollow portion at the center of the body. A movable core 6 is placed by being inserted from one of the two openings of the coil bobbin 5 while the two openings are kept substantially at the same height. Note that when the electromagnetic device is in operation, the movable core 6 can move freely in the cylindrical hollow portion of the coil bobbin 5 in the direction indicated by the arrow illustrated in FIG. 1. Movable core plates 7 to 10 are joined to both sides of the movable core 6 in the direction of movement of the movable core. The movable core plates 7 to 10 move with the movement of the movable core 6. The electromagnetic device in this embodiment is a switch.

A description will be given next of a characteristic configuration and a principle for reducing movable wear debris due to movement of the coil bobbin 5 and the movable core 6.

The side on which the movable core plates 9 and 10 are disposed is defined as the entry side and the side on which the movable core plates 7 and 8 are disposed is defined as the exit side, and accordingly, in the embodiment of the present invention, in a cylindrical hollow portion, a protrusion facing a part of the lower or upper half of the movable core 6 is formed in each of the range extending from the middle point between the entry side and the exit side to the entry side and the range extending from the middle point to the exit side.

In the embodiment of the present invention, a protrusion facing a part of the lower half of the movable core 6 is formed inside the cylindrical hollow portion in each of the ranges extending from the two openings to the middle point. Accordingly, the movable core 6 is supported by the two protrusions when the movable core 6 moves. For example, a first protrusion is formed in the range extending from the middle point between the entry that is one of the two openings and the exit that is the opening on the opposite side of the entry to the entry, while a second protrusion is formed in the range extending from the middle point to the exit; therefore, the movable core 6 is supported by the first protrusion and the second protrusion when the movable core 6 moves.

According to the first embodiment, as illustrated in FIG. 1, an example will be described where a first protrusion 11A1 and a second protrusion 11A2 are provided in the cylindrical hollow portion facing the lower half of the movable core 6 in ranges A1 and A2 extending from the two openings to the middle point of the cylindrical hollow portion of the coil bobbin 5, respectively, while a third protrusion 11B1 is provided in the cylindrical hollow portion facing the upper half of the movable core 6 in a range B1 extending from the entry to the middle point.

As illustrated in FIG. 1, with respect to the direction of movement of the movable core 6, the first protrusion is provided at the bottom in the range extending from the middle point between the entry and the exit that is the opening on the opposite side of the entry of the cylindrical hollow portion to the entry, whereas the second protrusion is provided at the position A2 such that it is symmetrical to the first protrusion about the central axis of the two openings of the cylindrical hollow portion, at the bottom in the range extending from the middle point to the exit. These protrusions come into contact with the movable core 6 to move when the electromagnetic device is in the process of being turned on or off.

In the first embodiment, with respect to the movable core 6 moving in a horizontal direction, the first protrusion 11A1 provided in the region A1 vertically below the movable core 6 in the cylindrical hollow portion of the coil bobbin 5 on the entry side and the second protrusion 11A2 provided in the region A2 vertically below the movable core 6 on the exit side are disposed to face each other with respect to the central axis of the cylindrical hollow portion. Moreover, the third protrusion is provided in the region B1 vertically above the movable core 6.

Figure 2:
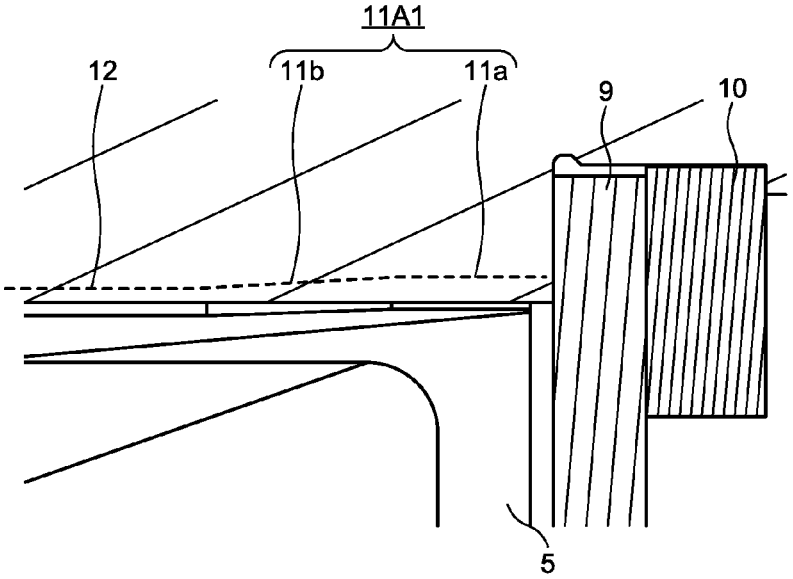
FIG. 2 is a detailed diagram illustrating a region A1 in FIG. 1 according to the first embodiment of the present invention.

FIG. 2 is a detailed diagram of the region A1 in FIG. 1 of the coil bobbin 5 according to the first embodiment. As illustrated in FIG. 2, the first protrusion 11A1 is disposed in the region A1 vertically below the movable core 6 with respect to the direction of movement of the movable core 6 on the inner peripheral surface of the cylindrical hollow portion of the coil bobbin 5 on the entry side, in a state where the electromagnetic device is turned on or off. The first protrusion 11A1 includes a contact portion 11*a* that comes into contact with the movable core 6 when the movable core 6 moves and a slope portion 11*b* that gently connects a difference in level between the contact portion 11*a* and the inner peripheral surface of the cylindrical hollow portion. The contact portion 11*a* has a surface along the circumference of the inner peripheral surface of the cylindrical hollow portion of the coil bobbin 5. When the electromagnetic device is in the process of being turned on or off, the contact portion 11*a* comes into contact with the movable core 6 so as to be able to inhibit the movement in a direction other than the direction of movement of the movable core 6. The first protrusion 11A1 also supports the weight of the movable core 6. The second protrusion 11A2 is placed in the region A2 extending from the exit to the middle point in FIG. 1. The second protrusion 11A2 has a configuration and a function similar to those of the first protrusion 11A1.

A non-protruding portion 12 is also provided. The movable core 6 moves in the cylindrical hollow portion of the coil bobbin 5 when the electromagnetic device is in the process of being turned on or off. At this time, the movable core 6 moves while being in contact with the contact portion 11*a* of each of the first protrusion 11A1 and the second protrusion 11A2. When the movable core 6 moves, movable wear debris is generated. The movable wear debris falls to the non-protruding portion 12 via the slope portion 11*b* due to the movement of the movable core 6 and thus does not build up in the contact portion 11*a*.

Figure 3:
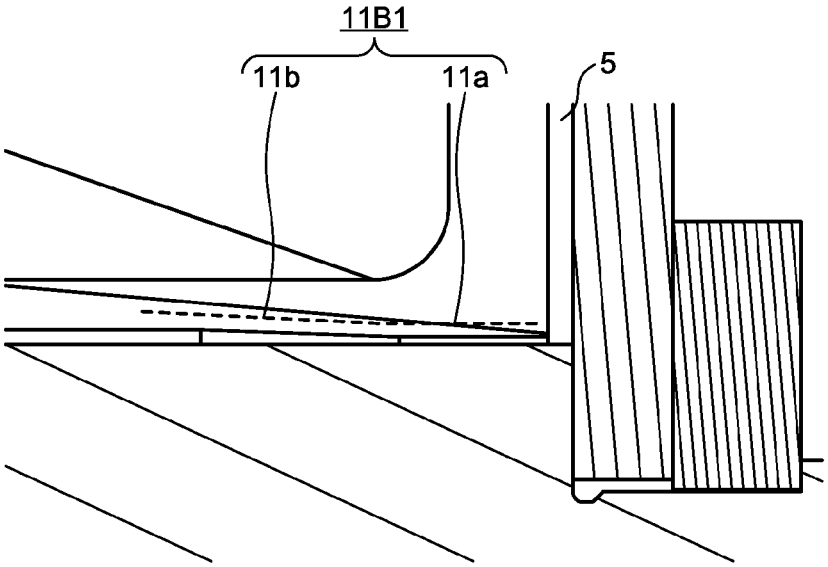
FIG. 3 is a detailed diagram illustrating a region B1 in FIG. 1 according to the first embodiment of the present invention.

FIG. 3 is a detailed diagram of the region B1 in FIG. 1 according to the first embodiment. As illustrated in FIG. 3, the third protrusion 11B1 is disposed in the region B1 vertically above the movable core 6 with respect to the direction of movement of the movable core 6 on the inner peripheral surface of the cylindrical hollow portion of the coil bobbin 5 on the entry side, in the state where the electromagnetic device is turned on or off. As with the first protrusion 11A1 in FIG. 2, the third protrusion 11B1 includes the contact portion 11*a* having the surface along the circumference of the inner peripheral surface of the cylindrical hollow portion of the coil bobbin 5 and the slope portion 11*b*. Moreover, these protrusions are made from a non-magnetic material as with the coil bobbin 5.

Furthermore, when the electromagnetic device is in the process of being turned on or off, the contact portion 11*a* of each of the first protrusion 11A1 and the second protrusion 11A2 is in contact with the movable core 6, at which time friction is exerted. The movable core 6 rises in order to avoid this friction. Accordingly, when the device is operated, the third protrusion 11B1 provided in a direction opposite to the direction of gravity of the movable core 6 inhibits the movable core 6 from rising.

Figure 4:
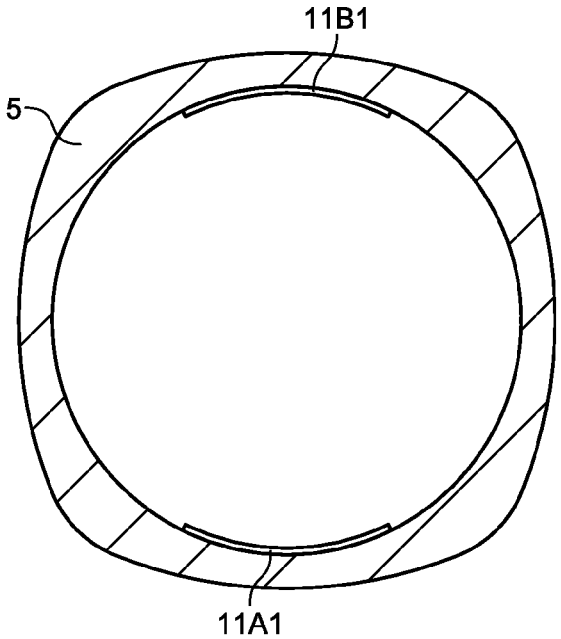
FIG. 4 is a sectional view illustrating the region A1 in FIG. 1 according to the first embodiment of the present invention.
Figure 5:
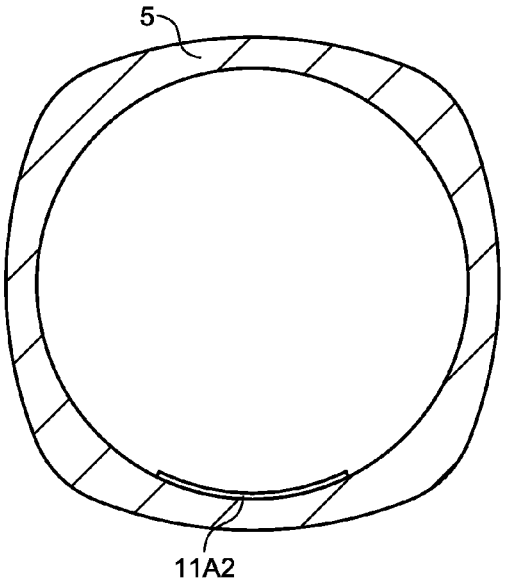
FIG. 5 is a sectional view illustrating a region A2 in FIG. 1 according to the first embodiment of the present invention.

FIG. 4 is a sectional view of the coil bobbin 5 as seen from the entry side. FIG. 5 is a sectional view of the coil bobbin 5 as seen from the exit side. FIGS. 4 and 5 also illustrate the shape of each protrusion.

Figure 6:
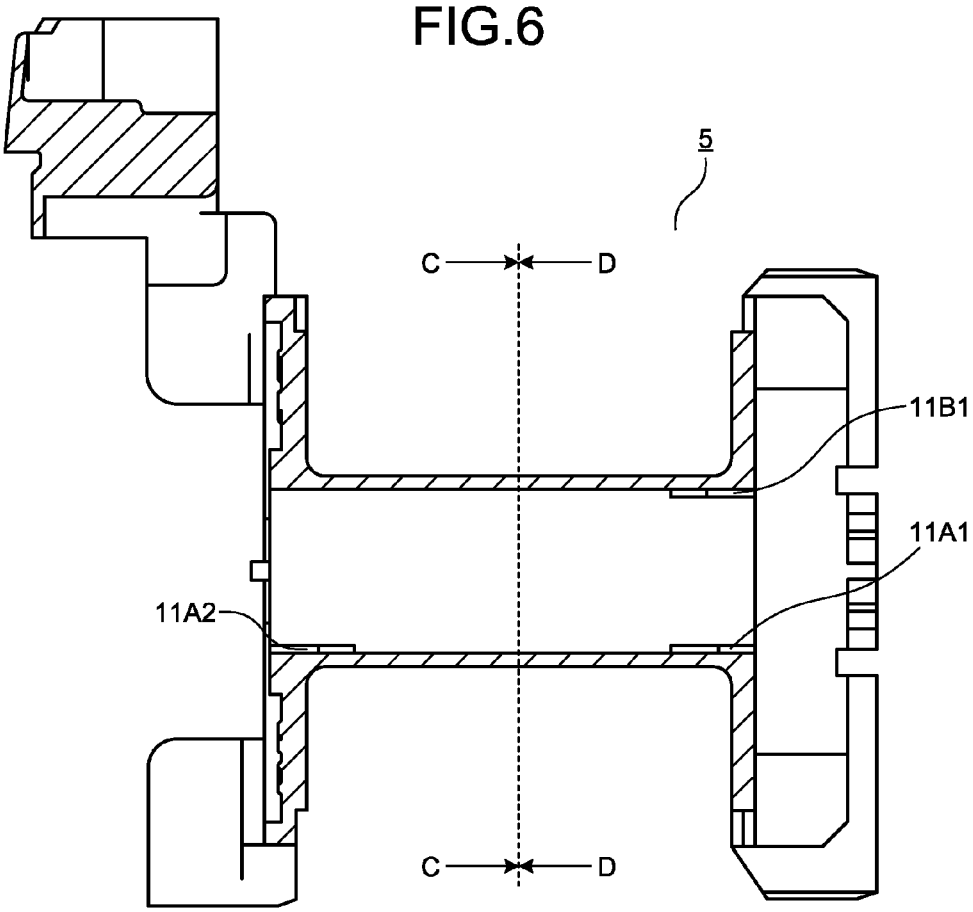
FIG. 6 is a sectional view in a lateral direction of a coil bobbin according to the first embodiment of the present invention.

FIG. 6 is a sectional view in a lateral direction of the coil bobbin 5. FIG. 6 illustrates the first protrusion 11A1 and the second protrusion 11A2 provided in the lower part of the coil bobbin 5 and the third protrusion 11B1 provided in the upper part of the coil bobbin 5.

Each of the first protrusion 11A1, the second protrusion 11A2, and the third protrusion 11B1 has an arch-shaped in cross section as illustrated in FIGS. 4 and 5.

When the diameter of the coil bobbin 5 equals 11.6 mm and the diameter of the movable core 6 equals 11 mm, for example, the first protrusion 11A1 and the third protrusion 11B1 illustrated in FIGS. 2 and 3 have dimensions where the contact portion 11*a* equals 3 mm and the slope portion 11*b* equals 3 mm in length in the direction of movement of the movable core 6. The shape and length of the protrusions are not limited to what is given in this example.

The operation of the first embodiment will now be described.

The movable core 6 moves in the cylindrical hollow portion of the coil bobbin 5 in a direction indicated by an arrow in FIG. 1 (X direction and Y direction). When voltage is applied to the coil 4, a magnetic field generated by the coil 4 drives the movable core 6 and the movable core plates 7, 8, 9, and 10 joined to the movable core 6 against the restoring force of a spring not illustrated, whereby the movable core plates 8 and 10 are held fast against the U-shaped fixed core 1 and as a result, the electromagnetic device is turned on.

Note that when excitation of the coil 4 is released, the movable core 6 as well as the movable core plates 7, 8, 9, and 10 are returned by the force of a spring not illustrated. The electromagnetic device is turned off when the movable core plate 9 is held fast against the auxiliary core 3, and can remain off due to the force of the permanent magnet 2.

With the basic structure of the electromagnetic device as described above, clearance is ensured between the coil bobbin 5 and the movable core 6 when the electromagnetic device is turned on or off; therefore, the coil bobbin 5 and the movable core 6 are not in contact with each other. The movable core 6 moves in the cylindrical hollow portion of the coil bobbin 5 when the electromagnetic device is the process of being turned on or off. Accordingly, in the conventional technologies, the movable core 6 and the coil bobbin 5 come into contact with each other. Consequently, when the electromagnetic device is in the process of being turned on or off, the bottom of the movable core 6 comes into contact with the bottom of the cylindrical hollow portion of the coil bobbin 5 to move in the direction of movement of the movable core 6. In the first embodiment, the first protrusion 11A1 and the second protrusion 11A2 move the movable core 6 while supporting them from below, whereby the movable core 6 comes into surface contact with the first protrusion 11A1 and the second protrusion 11A2; therefore, movable wear debris is reduced compared to a conventional contact. Consequently, movable wear debris is reduced when compared to the conventional case.

Note that generated movable wear debris falls to the non-protruding portion 12 via the slope portion 11*b* due to the movement of the movable core 6 and thus does not build up in the contact portion 11*a* and does not affect the movement.

When the electromagnetic device is in the process of being turned on or off, wear of the movable core 6 is caused by the movement thereof relative to mainly the protrusions provided on the lower inner peripheral surface of the cylindrical hollow portion of the coil bobbin 5 with respect to the direction of movement of the movable core 6. In the first embodiment, the wear of the lower part of the cylindrical hollow portion of the coil bobbin 5 is caused by the movement between the movable core 6 and each of the contact portion of the first protrusion 11A1 provided at the lower end portion A1 on the entry side and the contact portion of the second protrusion 11A2 provided at the lower end portion A2 on the exit side. However, the movable core 6 is in surface contact with each of the first protrusion 11A1 and the second protrusion 11A2; therefore, movable wear debris is less than that generated in the conventional technologies. Movable wear debris is thus reduced when compared to the conventional technologies. Moreover, even when generated movable wear debris builds up in the non-protruding portion 12, because the movable wear debris is reduced, it does not affect movability. As a result, the movement of the movable core 6 in the cylindrical hollow portion of the coil bobbin 5 becomes stable.

While the configuration of the first embodiment has been described, the arrangement of the protrusion provided in the upper part of the coil bobbin 5 of the first embodiment is not limited to the arrangement of the third protrusion 11B1. The protrusion may be disposed inside the cylindrical hollow portion facing a part of the upper half of the movable core 6 in each of the ranges extending from the two openings to the middle point.

According to the first embodiment, an unnecessary movement, such as a vertical movement, other than the movement in the direction of movement of the movable core 6 is inhibited while at the same time the wear caused by the movement is reduced; therefore, generation of movable wear debris can be inhibited. Moreover, even when movable wear debris is generated, the generated movable wear debris falls to the non-protruding portion 12 via the slope portion 11*b*. As a result, the movable wear debris does not build up in the contact portion 11*a* of the protrusion, whereby an increase in the friction of the movable core 6 can be suppressed. A smooth, stable movement of the movable core 6 can thus be ensured in the cylindrical hollow portion of the coil bobbin 5. The life of the electromagnetic device can be extended as well.

In the first embodiment, when each of the protrusions disposed at the symmetrical positions on the inner peripheral surface of the cylindrical hollow portion of the coil bobbin 5 has the shape of a protrusion at the tip of a general cone, semicircle, or the like, the surface in contact with the movable core 6 is reduced to accelerate wearing and increase the movable wear debris.

Moreover, when the protrusion has the shape of a bearing or the like, the surface in contact with the movable core 6 is increased, and thus the friction is increased. Accordingly, provision of the general tip protrusion or bearing affects the on or off operation.

For convenience of description, the description herein is of the case where the protrusion is provided in the upper and lower parts at both ends of the cylindrical hollow portion of the coil bobbin 5, but the position at which the protrusion is disposed is not limited to both ends of the coil bobbin 5.

Moreover, the shape and configuration of the protrusions in the first embodiment are not limited to those of the first protrusion 11A1. The first protrusion 11A1 may be composed of a plurality of protrusions, for example. In this case, when the movable core 6 moves inside the cylindrical hollow portion due to magnetic force generated by energization of the coil 4, the protrusions are disposed at positions to support at least two points on the side face of the movable core 6 such that the lowest point of the movable core 6 is located between the two points in such a manner that the lowest point is not in contact with the lower end of the entry.

On the other hand, the second protrusion may also be composed of a plurality of protrusions as with the first protrusion. In the case where the first protrusion or the second protrusion is composed of a plurality of protrusions as described above, when the movable core 6 moves, one side of the movable core 6 is supported by the first protrusion 11A1 or the second protrusion 11A2 and the other side of the movable core 6 is supported while the side face of the lower half thereof is sandwiched between the protrusions. Alternatively, in the case where the first protrusion and the second protrusion are both composed of a plurality of protrusions, when the movable core 6 moves, both sides of the movable core 6 are supported while the side face of the lower half of the movable core 6 is sandwiched between the protrusions.

Second Embodiment

A second embodiment of the present invention will now be described with reference to FIG. 1. Components common to the first and second embodiments will be described while assigning thereto the same reference numerals as those assigned in the first embodiment.

The first protrusion 11A1 and the second protrusion 11A2 in the electromagnetic device of the first embodiment are provided in the region A1 vertically below the movable core 6 on the inner peripheral surface of the cylindrical hollow portion of the coil bobbin 5 on the entry side and in the region A2 vertically below the movable core 6 on the inner peripheral surface of the cylindrical hollow portion of the coil bobbin 5 on the exit side in the direction perpendicular to the direction of movement of the movable core 6, while the third protrusion 11B1 is provided in the region B1 vertically above the movable core 6 on the inner peripheral surface of the cylindrical hollow portion of the coil bobbin 5 on the entry side. The second embodiment of the present invention is further provided with a fourth protrusion in a region B2 vertically above the movable core 6 on the inner peripheral surface of the cylindrical hollow portion of the coil bobbin 5 on the exit side, in addition to the arrangement of the first protrusion 11A1, the second protrusion 11A2, and the third protrusion 11B1 in the first embodiment.

That is, according to the second embodiment, as illustrated in FIG. 1, a protrusion is provided in each of the regions A1 and B1 vertically below and above the movable core 6 on the inner peripheral surface of the cylindrical hollow portion of the coil bobbin 5 on the entry side, while a protrusion is provided in each of the regions A2 and B2 vertically below and above the movable core 6 on the inner peripheral surface on the exit side. With this configuration, with respect to the direction of movement of the movable core 6, a protrusion supporting the movable core 6 is provided in each of the regions A1 and A2 below the movable core 6 on the inner peripheral surface of the cylindrical hollow portion on the entry side and the exit side of the coil bobbin 5, respectively, and a protrusion inhibiting the movable core 6 from rising when the movable core 6 moves is provided in each of the regions B1 and B2 above the movable core 6 on the inner peripheral surface of the cylindrical hollow portion on the entry side and the exit side of the coil bobbin 5, respectively. That is, the third protrusion and the fourth protrusion are provided to inhibit the movable core 6 from rising when the movable core 6 moves.

Then, according to the second embodiment of the present invention, the protrusion provided on the inner peripheral surface of the cylindrical hollow portion of the coil bobbin 5 can bring about the effect of stabilizing the movement of the coil bobbin 5 and the movable core 6 as with the first embodiment.

Third Embodiment

A third embodiment of the present invention will now be described with reference to FIGS. 7, 8, 9, and 10. Components common to the third and aforementioned embodiments will be described while assigning thereto the same reference numerals as those assigned in the aforementioned embodiment.

Figure 7:
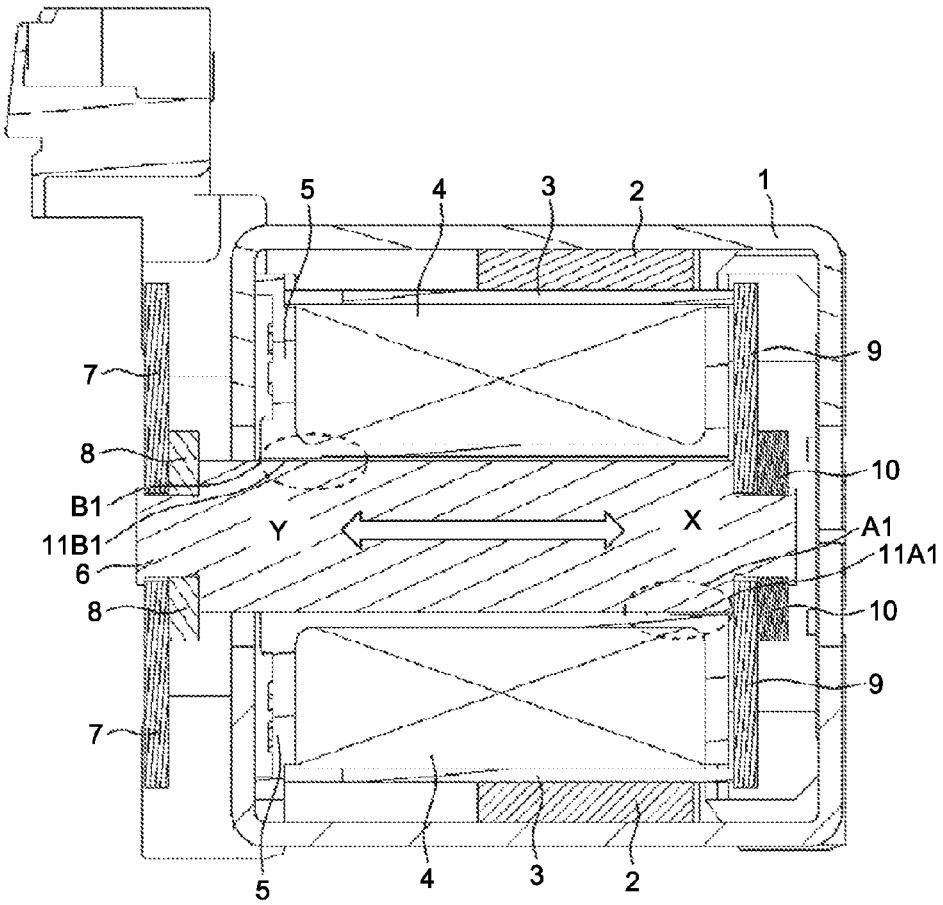
FIG. 7 is a sectional view in a lateral direction of an electromagnetic device according to a third embodiment of the present invention.

FIG. 7 is a sectional view of an electromagnetic device provided with protrusions according to the third embodiment. As illustrated in FIG. 7, a protrusion is provided in each of the lower part A1 on the entry side and the upper part B1 on the exit side of the cylindrical hollow portion of the coil bobbin 5 and, in addition to the arrangement of these two protrusions, a plurality of protrusions not illustrated are provided. Next, a description will be given of a case where protrusions are provided at positions 120 degrees to the right and left of each of the first protrusion 11A1 and the second protrusion 11B1.

Figure 8:
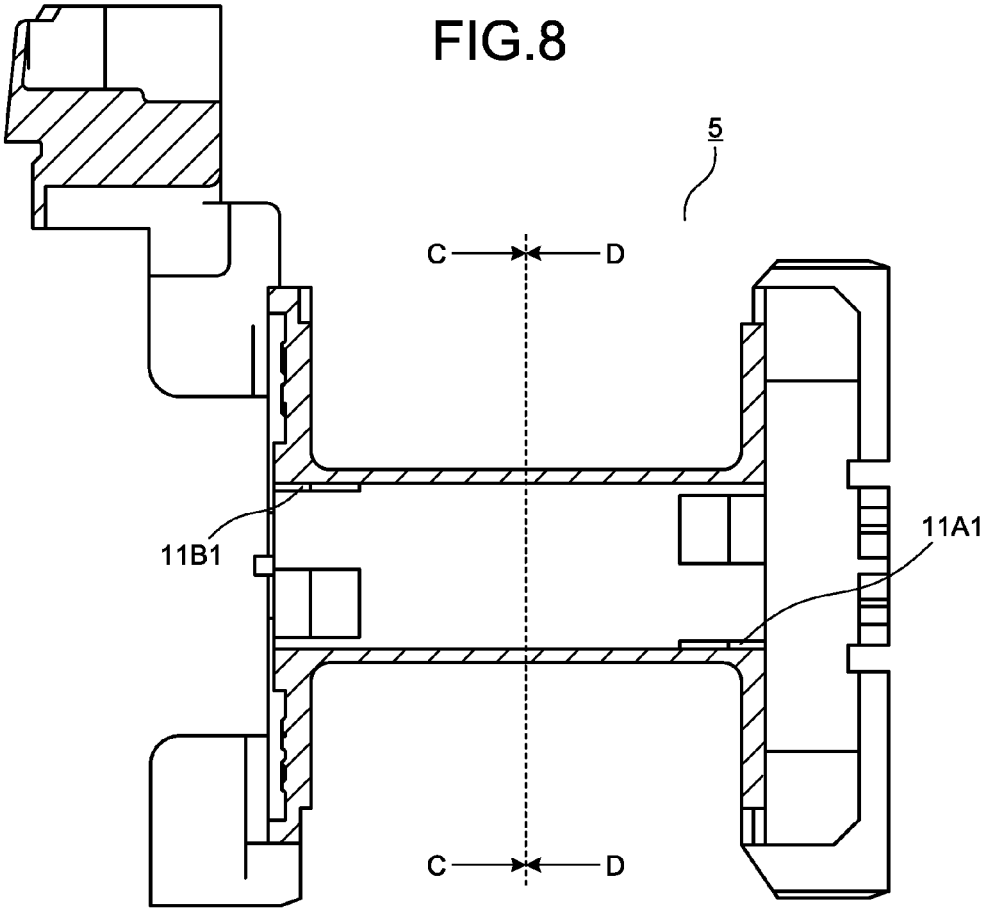
FIG. 8 is a sectional view in a lateral direction of a coil bobbin according to the third embodiment of the present invention.

FIG. 8 is a sectional view of the coil bobbin 5 according to the embodiment of the present invention. The first protrusion is provided in the lower part of the entry of the coil bobbin 5 while the second protrusion is provided in the upper part of the exit of the coil bobbin 5.

Figure 9:
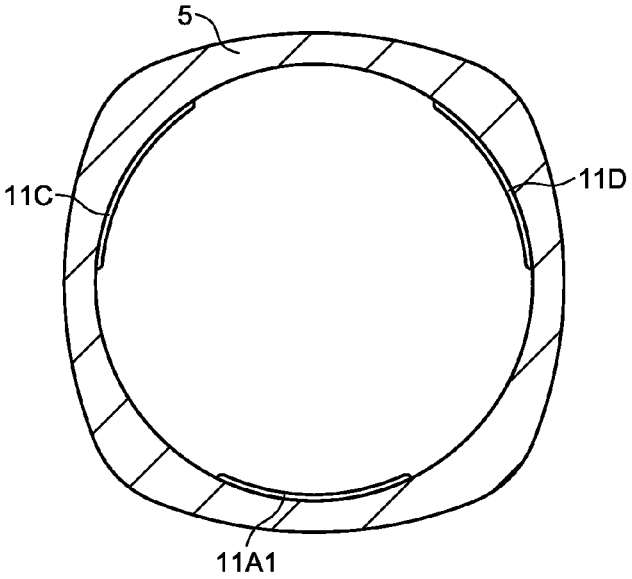
FIG. 9 is a sectional view illustrating the coil bobbin in FIG. 8 according to the third embodiment of the present invention as viewed in the direction of the arrows C-C.

FIG. 9 illustrates a sectional view of the coil bobbin 5 in FIG. 8 as viewed in the direction of the arrows C-C. FIG. 9 illustrates a plurality of protrusions provided on the inner peripheral surface of the cylindrical hollow portion of the coil bobbin 5 on the entry side in a direction perpendicular to the direction of movement of the movable core 6.

As illustrated in FIG. 9, the first protrusion 11A1 is provided in the region A1 vertically below the movable core 6 on the inner peripheral surface of the cylindrical hollow portion of the coil bobbin 5 on the entry side in FIG. 7 with respect to the direction of movement of the movable core 6. Two protrusions 11C and 11D are further provided at positions 120 degrees to the left and right of the first protrusion 11A1. That is, the three protrusions 11A1, 11C, and 11D are disposed on the inner peripheral surface of the cylindrical hollow portion of the coil bobbin 5 on the entry side. The protrusion 11C is disposed at the position 120 degrees to the left of the first protrusion 11A1 on the circumference of the inner peripheral surface of the cylindrical hollow portion in the coil bobbin 5. The protrusion 11D is disposed at the position 120 degrees to the right of the first protrusion 11A1 on the circumference of the inner peripheral surface of the cylindrical hollow portion in the coil bobbin 5. Note that the angle of arrangement of the protrusions is not limited to 120 degrees.

Figure 10:
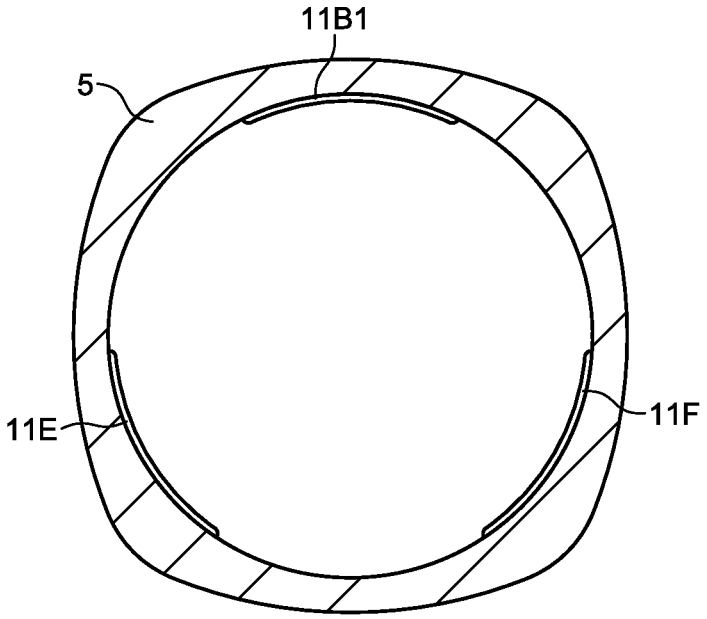
FIG. 10 is a sectional view illustrating the coil bobbin in FIG. 8 according to the third embodiment of the present invention as viewed in the direction of the arrows D-D.

FIG. 10 illustrates a sectional view of the coil bobbin 5 in FIG. 8 as viewed in the direction of the arrows D-D. FIG. 10 illustrates a plurality of protrusions provided on the inner peripheral surface of the cylindrical hollow portion of the coil bobbin 5 on the exit side with respect to the direction of movement of the movable core 6.

As illustrated in FIG. 10, the second protrusion 11B1 is provided in the region B1 vertically above the movable core 6 on the inner peripheral surface of the cylindrical hollow portion of the coil bobbin 5 on the exit side in FIG. 7 with respect to the direction of movement of the movable core 6. As with FIG. 9, two protrusions 11E and 11F are further provided at positions 120 degrees to the left and right of the second protrusion 11B1. The three protrusions 11B1, 11E, and 11F are disposed on the inner peripheral surface of the cylindrical hollow portion of the coil bobbin 5 on the exit side in a manner similar to that on the entry side. The protrusion 11E is disposed at the position 120 degrees to the left of the second protrusion 11B1 on the circumference of the inner peripheral surface of the cylindrical hollow portion in the coil bobbin 5. The protrusion 11F is disposed at the position 120 degrees to the right of the second protrusion 11B1 on the circumference of the inner peripheral surface of the cylindrical hollow portion in the coil bobbin 5. Note that the angle of arrangement of the protrusion is not limited to 120 degrees.

The electromagnetic device in the third embodiment includes a plurality of protrusions placed on the surface along the circumference of the inner peripheral surface of the cylindrical hollow portion in the coil bobbin 5. The arrangement of these protrusions can inhibit the movement of the movable core 6 not only in the vertical direction but in the horizontal and oblique directions when the electromagnetic device is in the process of being turned on or off. Therefore, stable movability can be ensured.

Fourth Embodiment

A fourth embodiment of the present invention will now be described.

The fourth embodiment is adapted by interchanging the arrangement on the entry side and the arrangement on the exit side in the third embodiment, where two protrusions are further provided at positions 120 degrees to the right and left of the protrusion provided in a lower part on the exit side, and two protrusions are further provided at positions 120 degrees to the right and left of the protrusion provided in an upper part on the entry side.

The fourth embodiment is adapted by interchanging the arrangement on the entry side and the arrangement on the exit side in the third embodiment; therefore, as with the effect of the third embodiment, the movement of the movable core 6 can be inhibited not only in the vertical direction but in the horizontal and oblique directions when an electromagnetic device is in the process of being turned on or off. Therefore, stable movability can be ensured.

While the first to fourth embodiments have been described with the protrusions symmetrically disposed on each of the two end sides of the coil bobbin, the arrangement is not limited to the symmetrical arrangement.

INDUSTRIAL APPLICABILITY

The electromagnetic device of the present invention can be applied to a switch, an electromagnetic contactor, or the like.

REFERENCE SIGNS LIST

1 fixed core, 2 permanent magnet, 3 auxiliary core, 4 coil, 5 coil bobbin, 6 movable core, 7 to 10 movable core plate, 11A1 first protrusion, 11B1 third protrusion (first embodiment), 11B1 second protrusion (third embodiment), 11C protrusion, 11D protrusion, 11E protrusion, 11F protrusion, 11*a* contact portion, 11*b* slope portion, 12 non-protruding portion

The invention claimed is:

1. An electromagnetic device comprising:

a movable core;

a coil bobbin to be used with a coil wound around a body and provided with a cylindrical hollow portion in a center of the body, the movable core being inserted into the coil bobbin from one of two openings of the cylindrical hollow portion;

a first movable core plate joined to one end of the movable core;

a second movable core plate joined to another end of the movable core;

a fixed core for holding the first movable core plate thereagainst; and an auxiliary core for holding the second movable core plate thereagainst, wherein the two openings are maintained at substantially a same height in a state where the movable core is inserted in the coil bobbin, and the electromagnetic device moves the movable core due to magnetic force generated by energization of the coil, a first protrusion, a second protrusion, and a third protrusion are formed on an inner peripheral surface of the cylindrical hollow portion of the coil bobbin, the first protrusion facing part of a lower half of the movable core and the third protrusion facing part of an upper half of the movable core are formed on the inner peripheral surface of the cylindrical hollow portion in one of ranges extending from the two openings to a middle point of the coil bobbin, no protrusion is formed on part of the inner peripheral surface of the cylindrical hollow portion facing part of an upper half of the movable core in another of the ranges extending from the two openings to the middle point of the coil bobbin, the second protrusion facing part of a lower half of the movable core is formed on the inner peripheral surface of the cylindrical hollow portion in the another of the ranges extending from the two openings to the middle point of the coil bobbin, the movable core is supported by the first protrusion and the second protrusion when the movable core moves, and when the movable core does not move, the first movable core plate is held against the fixed core due to the magnetic force so that the movable core is supported or the second movable core plate is held against the auxiliary core due to magnetic force of a permanent magnet included in the electromagnetic device so that the movable core is supported.

2. The electromagnetic device according to claim 1, wherein the first protrusion or the second protrusion includes a plurality of protrusions, and the protrusions are disposed at positions to support at least two points on a side surface of the movable core such that a lowest point of the movable core is located between the two points in such a manner that the lowest point is not in contact with a lower end of an entry that is one of the two openings, when the movable core moves in the cylindrical hollow portion due to magnetic force generated by energization of the coil.

3. The electromagnetic device according to claim 1, wherein the first protrusion and the second protrusion are provided vertically below the movable core that moves-in the cylindrical hollow portion.

4. The electromagnetic device according to claim 1, wherein the third protrusion is provided vertically above the movable core that moves in the cylindrical hollow portion.

5. The electromagnetic device according to claim 1, wherein each of the first protrusion and the third protrusion includes a contact portion that is in contact with the movable core when the movable core moves, and a slope portion that gently connects a difference in level between the contact portion and the inner peripheral surface of the cylindrical hollow portion.

6. The electromagnetic device according to claim 1, wherein the second protrusion includes a contact portion that is in contact with the movable core when the movable core moves, and a slope portion that gently connects a difference in level between the contact portion and the inner peripheral surface of the cylindrical hollow portion.

* * * * *